United States Patent [19]

Sykes

[11] Patent Number: 4,485,933

[45] Date of Patent: Dec. 4, 1984

[54] CLOSURE FOR RECEPTACLES CONTAINING A PRESSURIZED GAS

[75] Inventor: Donald J. Sykes, Upper Saddle River, N.J.

[73] Assignee: Marpac Industries, Inc., Allendale, N.J.

[21] Appl. No.: 548,719

[22] Filed: Nov. 4, 1983

[51] Int. Cl.[3] ..... B65D 53/00

[52] U.S. Cl. ..... 215/250; 215/271

[58] Field of Search ..... 215/250, 260, 269, 270, 215/271

[56] References Cited

U.S. PATENT DOCUMENTS

| | | | |
|---|---|---|---|
| 1,163,968 | 12/1915 | Caspers et al. | 215/271 |
| 1,804,627 | 5/1931 | Lukenbill | 215/271 X |
| 1,884,883 | 10/1932 | Schollmeyer | 215/271 X |
| 2,040,798 | 5/1936 | Schoonmaker | 215/271 |
| 2,634,014 | 4/1953 | Kimber | 215/271 X |
| 2,986,297 | 5/1961 | Pollick | 215/271 |

FOREIGN PATENT DOCUMENTS

| | | | |
|---|---|---|---|
| 97265 | 10/1939 | Sweden | 215/271 |

*Primary Examiner*—Steven M. Pollard
*Attorney, Agent, or Firm*—W. Patrick Quast

[57] ABSTRACT

An improved closure for a bottle containing a gas-emitting solution. The closure is screwed onto the bottle and includes a disk member having a centrally disposed opening. The opening is sealed with a rupturable seal member. Two concentric, cylindrical members are disposed about the opening. A ballon-like member is fixedly secured to the open end of the cylindrical member next adjacent the opening so that when the gas emitting from the solution ruptures the seal member, the balloon is inflated to indicate excessive pressure.

4 Claims, 2 Drawing Figures

CLOSURE FOR RECEPTACLES CONTAINING A PRESSURIZED GAS

FIELD OF THE INVENTION

This invention pertains generally to a special type of bottle closure and more particularly, to a closure responsive to the build up of gas pressure in a receptacle, bottle or other container.

BACKGROUND

Certain chemical solutions are sufficiently, chemically active to continually emit a gaseous by-product. Generally, the concern of the present application, are those solutions which generate gases at a very slow rate. Thus with time, the pressure in a closed vessel containing the solution will continue to increase unless relieved.

Such a problem has been addressed with the development of special, pressurized containers and closures. Typically, the containers are metalized, high strength receptacles, relatively expensive to manufacture. Alternately a special closure must be provided which relieves the pressure before opening; or extreme care must be taken.

An area employing chemical solutions giving rise to the problems noted above, is the photoresist utilized in the semiconductor and electronics industry. These are unique formulations which react, emitting a gas at a slow rate. The time for the gas pressure to build to a relatively dangerous level for the typical storage containers (32–128 fl. oz.) may be in the order of 6–12 months.

Further, therefore, there has been no simple, practical means for indicating the possible build up of pressure in the bottle.

Therefore, it is a primary object of this invention to provide an improved closure for bottles containing gas emitting solutions, which would provide both a warning of increase in gas pressure as well as partial relief from the developing pressure.

It is a further object to provide a relatively inexpensive and simple closure which will accomplish this.

SUMMARY OF THE INVENTION

Towards the accomplishment of these and other objects and advantages which may become apparent from the following description and accompanying drawings, there is described an improved closure for a bottle or like receptacle containing a gas emitting solution, the bottle having a neck portion including means for securing the closure thereto, the improved closure comprising a first cylindrical portion including cooperative, securing means for securing the closure to the neck portion of the bottle; a disk member contiguous and perpendicular to said first cylindrical portion, the disk member including a centrally disposed opening therethrough which is covered by a rupturable, seal member. Second cylindrical means including third and fourth cylindrical members is concentrically disposed about the centrally disposed opening in the disk member. A balloon-like member is fixedly secured to the open end of the cylindrical member next adjacent the opening. The outer cylindrical member disposed about the opening extends a greater distance above the disk member to protect it from unintended rupturing.

BRIEF DESCRIPTION OF THE DRAWINGS

In order to have a better understanding of the principles of the present invention, a consideration of the accompanying drawings and following description is appropriate. In the drawings.

DESCRIPTION OF THE PREFERRED EMBODIMENT

Figure 1:
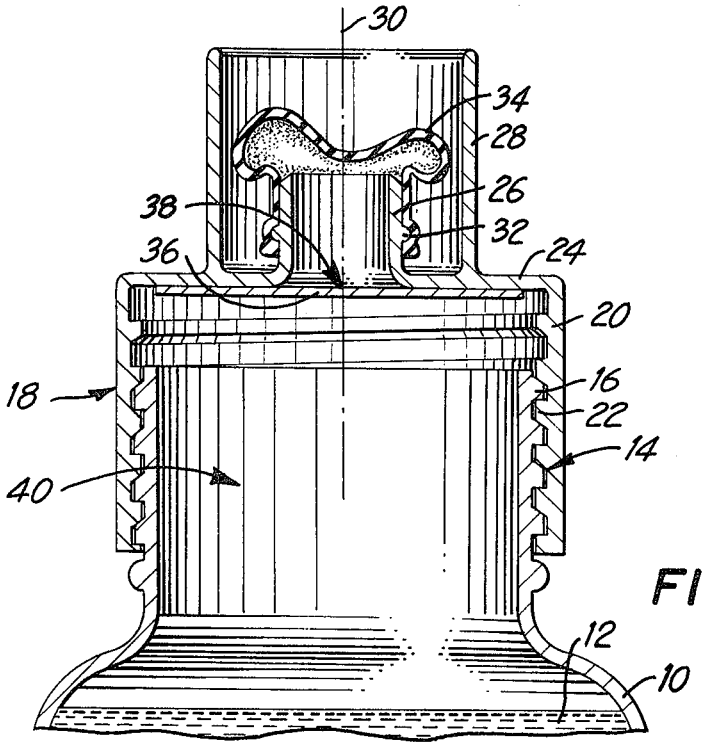
FIG. 1 is an elevation view showing the top of a bottle containing a gas emitting solution showing the improved closure of the present invention prior to gas build up.

Referring to FIG. 1, a bottle member 10 is depicted as containing a chemical solution 12. The bottle includes a threaded neck portion 14 having standard thread 16.

Capping the threaded neck portion is a closure 18 embodying the principles of the present invention. The closure 18 includes a cylindrical portion 20 which includes cooperating, threads 22 which co-act with threads 16 to secure the closure to the bottle.

The closure member 18 further includes an upper disk member 24 contiguous to and perpendicular with the cylindrical portion 20.

Central to the disk member 24 are two concentric, cylindrical members, 26 and 28. These extend upward "as viewed in FIG. 1" in the direction of the longitudinal axis 30 of the bottle and closure.

Cylindircal member 28 is concentrically disposed outward of cylindrical member 26 and extends further in the direction of longitudinal axis 30.

In the preferred embodiment, cylindrical member 26 includes an annular ring portion 32 about its outer perimeter.

Cooperatively connecting or connected with the annular ring is the neck portion of a balloon-like member 34. The latter is secured to the annular ring as well by a suitable adhesive or clip sufficient to withstand the forces which will be exerted on the balloon-like member when the seal 36 is ruptured. The primary function of the cylindrical member 28 is to extend upward above the cylindrical member 26 and the balloon contained within, so as to protect the balloon-like member from any possible rupturing during normal, handling procedures.

Disposed across the opening formed between the cylindrical member 26 and the disk member 24 is a seal 36. This is disposed over the opening 38. The seal member 36 is made from a relatively thin, rubber, plastic or metal foil material which is secured to the underside of disk member 24 by suitable means, such as adhesive. The thickness of the material forming the seal 36 would depend on various parameter including the type of material selected for the seal; the anticipated gas pressures to be experienced; the pressure tolerence of the bottle; etc. The general rule would require that the seal rupture before the pressure in the bottle reached a hazardous level.

Figure 2:
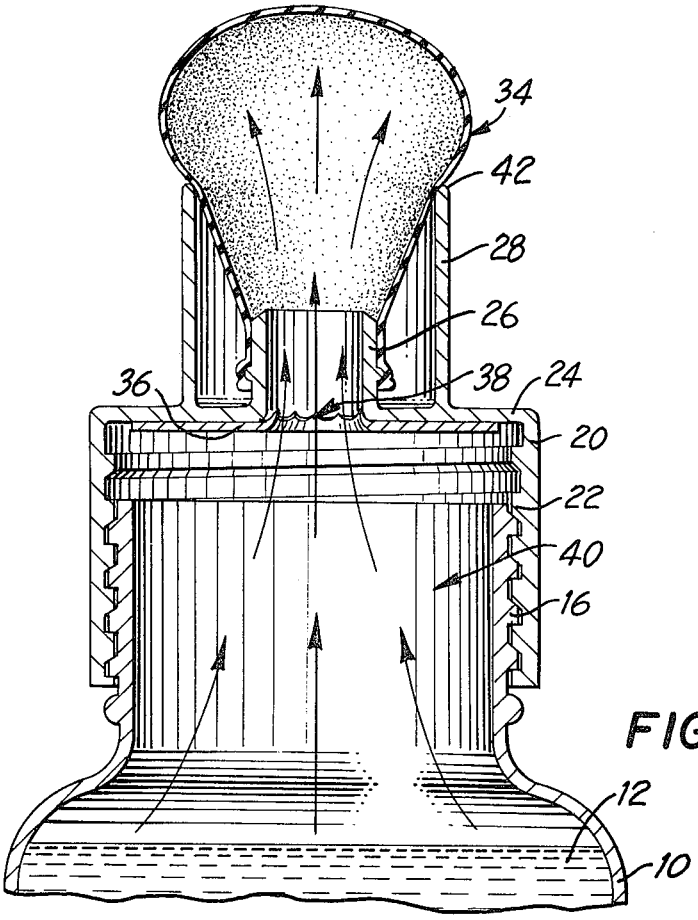
FIG. 2 shows the warning and pressure relief aspects of the improved closure after a period of time.

Referring now to FIG. 2, the elapsed time is now such that the pressure build up in the interior volume 30 of the bottle has exceeded the rupture threshhold of the seal member 36. The latter is seen as ruptured through at the opening 38.

When this occurs, pressurized gas escapes from the volume 40 in the direction of the arrows, through the opening 38, into the interior of balloon-like member 34.

The balloon expands so that it now becomes visible above the upper most portion 42 or cylindrical member 28.

With the inflation of the balloon-like member 34, the person responsible for the condition of the solution contained within the bottle is provided with a visual indicator of the excessive pressure build up. The technician can then carefully relieve the pressure within the bottle by slowly unscrewing the cap. or, disgard the bottle and solution completely if in fact this is indicative of a deteriorated potency; or, take whatever other steps are appropriate.

Although a preferred emobidment of the principle of the invention has been described, it is to be understood in view of the above, that modifications can be effected which are within the scope of the invention. For example, although the above describes a closure which can be molded in one piece, alternately the inner concentric cylindrical member 26, can be formed as a separate plastic piece which is inserted concentrically within member 28 and secured to disk member 24 in some suitable fashion, e.g. adhesive or sonic welding. This is appropriate where it is necessary to modify existing bottle closures.

Other modifications, again, should now be apparent. The above description is not to be considered limiting as to the breadth of the invention which is governed by the scope of the appended claims.

What is claimed is:

1. An improved closure for a bottle or like receptacle containing a gas-emitting solution, the bottle having a neck portion including means for securing the closure thereto, the improved closure comprising:

(a) a first cylindrical portion including cooperative, securing means for securing the closure to the neck portion of the bottle;

(b) a disk member contiguous and perpendicular to said first cylindrical portion, said disk member including a centrally, disposed opening therethrough;

(c) a rupturable, seal member secured to said disk member and positioned over said centrally disposed opening;

(d) second cylindrical means fixedly secured to said disk member and centrally disposed about said opening in said disk member, said second cylindrical means perpendicular to said disk member and having at least a first open end; and, (e) a balloon-like member fixedly secured to an open end of said second cylindrical means, whereby the pressure created by the gas emitted from the solution eventually ruptures said seal member, fills said balloon and causes the latter to rupture, unless the pressure is otherwise relieved.

2. The improved closure claimed in claim 1, wherein said second cylindrical means comprises third and fourth cylindrical members, the third cylindrical member concentrically disposed about said centrally, disposed, opening and within said fourth cylindrical member, said balloon-like member fixedly secured to the open end of said third cylindrical member.

3. The closure claimed in claim 2, wherein said fourth cylindrical member extends a greater distance above the disk member than the third cylindrical member.

4. The closure claimed in claim 3, wherein said closure, save the seal member, is molded in one piece.

* * * * *